US007768483B2

(12) United States Patent
Chan et al.

(10) Patent No.: US 7,768,483 B2
(45) Date of Patent: Aug. 3, 2010

(54) PIXELS AND DISPLAY PANELS

(75) Inventors: Chuan-Yi Chan, Taipei (TW); Ping-Lin Liu, Tainan (TW); Du-Zen Peng, Hsinchu County (TW)

(73) Assignee: TPO Displays Corp., Miao-Li County (TW)

( * ) Notice: Subject to any disclaimer, the term of this patent is extended or adjusted under 35 U.S.C. 154(b) by 598 days.

(21) Appl. No.: 11/772,329

(22) Filed: Jul. 2, 2007

(65) Prior Publication Data

US 2009/0009439 A1 Jan. 8, 2009

(51) Int. Cl.
*G09G 3/30* (2006.01)

(52) U.S. Cl. ..... 345/76; 345/82; 315/169.3

(58) Field of Classification Search ..... 345/76–84
See application file for complete search history.

(56) References Cited

U.S. PATENT DOCUMENTS 7,408,533 B2 * 8/2008 Eom et al. ..... 345/76
7,656,369 B2 * 2/2010 Chung et al. ..... 345/80

* cited by examiner

*Primary Examiner*—Duc Q Dinh
(74) *Attorney, Agent, or Firm*—Thomas, Kayden, Horstemeyer & Risley

(57) ABSTRACT

A pixel and a display panel using the pixel are provided. In the pixel, a driving element provides a driving circuit according to a data signal and a reference voltage to drive a light-emitting element to emit light. The electrical difference of the driving elements due to the fabrication process thereof does not affect the brightness of the light-emitting elements. Moreover, unequal brightness resulted from the equivalent resistance of the power lines is also prevented.

20 Claims, 7 Drawing Sheets

PIXELS AND DISPLAY PANELS

BACKGROUND

The present invention relates to a pixel, and in particular, to a pixel employed in an organic light emitting display panel.

FIG. 1 is a schematic diagram of a conventional pixel of a display array of an organic light emitting display panel. As shown in FIG. 1, a pixel 1 corresponds to interlaced data line DL and scan line SL and comprises a switch transistor 10, a storage capacitor 11, a driving transistor 12, and an organic light-emitting diode (OLED) 13. In FIG. 1, the driving transistor 12 is a PMOS transistor, for example.

Because the OLED 13 is a current-driving element, the brightness of the OLED 13 is determined by the intensity of the driving current Id provided by the driving transistor 12. The driving current Id is a drain current of the driving transistor 12 and refers to the driving capability thereof. The driving current Id is represented by the following equation:

$$id=1/2\cdot k\cdot(vsg-|vth|)^2$$

where id, k, vsg and vth represent a value of the driving current Id, a conductive parameter of the driving transistor 12, a value of the source-gate voltage Vsg of the driving transistor 12, and a threshold voltage of the driving transistor 12 respectively.

Because the driving transistors in different regions of the display array are not electrically identical due to the fabrication process thereof, the threshold voltages of the driving transistors are unequal. When the pixels within different regions receive the same video signal, the driving current respectively provided by the driving transistors of the pixels is not equal due to the unequal threshold voltages of the driving transistors. Thus, brightness of the OLEDs is not equal, resulting in unequal OLED light-emission intensity in a frame cycle and uneven images displayed on the panel.

SUMMARY

The invention provides a pixel. An exemplary embodiment of a pixel comprises a capacitor, transfer circuit, first to third switch elements, a driving element, and a light-emitting element. The capacitor is coupled between the first node and a second node. The transfer circuit is coupled to the first node and transfers a data signal or a reference voltage to the first node. A first terminal of the first switch element is coupled to the second node, and a second terminal thereof is coupled to a third node. A first terminal of the second switch element is coupled to the third node, and a second terminal thereof receives a clock signal. A control terminal of the driving element is coupled to the second node, a first terminal thereof is coupled to a supply voltage source, and a second terminal thereof is coupled to a control terminal of the first switch element at a fourth node. A control terminal of the third switch element receives an emitting signal, and a first terminal thereof is coupled to the fourth node. The light-emitting element is coupled between a second terminal of the third switch element and a ground.

In some embodiment, a control terminal of the fourth switch element receives the scan signal. In other some embodiment, the control terminal of the fourth switch element receives a control signal provided by a scan driver or an extra control circuit.

DESCRIPTION OF THE DRAWINGS

The present invention will become more fully understood from the detailed description given hereinbelow and the accompanying drawings, given by way of illustration only and thus not intended to be limitative of the present invention, where.

DETAILED DESCRIPTION

The following description is of the best-contemplated mode of carrying out the invention. This description is made for the purpose of illustrating the general principles of the invention and should not be taken in a limiting sense. The scope of the invention is best determined by reference to the appended claims.

Display panels are provided. In an exemplary embodiment of a display panel shown in FIG. 2, a display panel comprises a data driver 20, a scan driver 21, a display array 22, sequentially disposed data lines $DL_1$, to $DL_n$, and sequentially disposed scan lines $SL_1$ to $SL_m$. The display array 22 is formed by the interlaced data lines $DL_1$ to $DL_n$ and scan lines $SL_1$, to $SL_m$. The interlaced data line and scan line correspond to a pixel. For example, the interlaced data line $DL_1$ and first scan line $SL_1$ correspond to a pixel 200. The data driver 20 provides data signals $DS_1$ to $DS_n$, through the data lines $DL_1$ to $DL_n$, respectively. The scan driver 21 provides scan signals $SS_1$ to $SS_m$ respectively through the scan lines $SL_1$ to $SL_m$.

Figure 1:
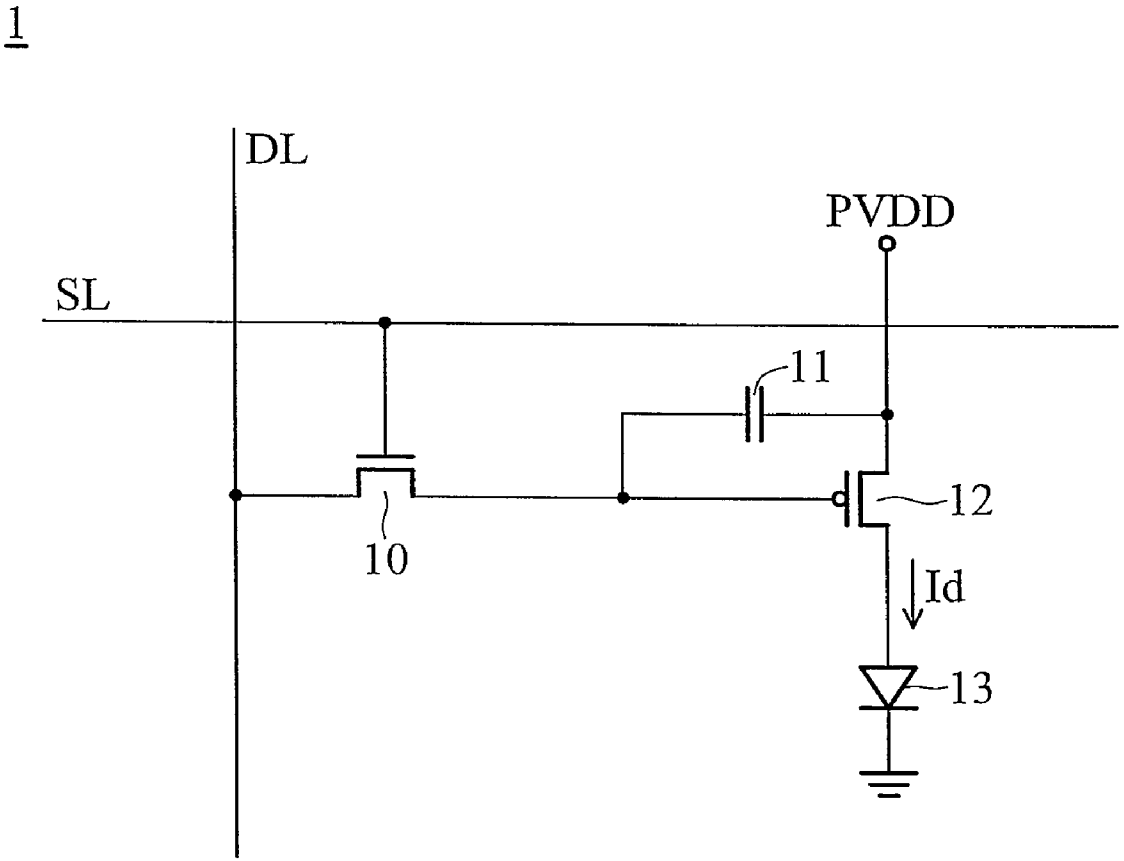
FIG. 1 ( RELATED ART )
FIG. 1 is a schematic diagram of a conventional pixel of an organic light emitting display panel.
Figure 2:
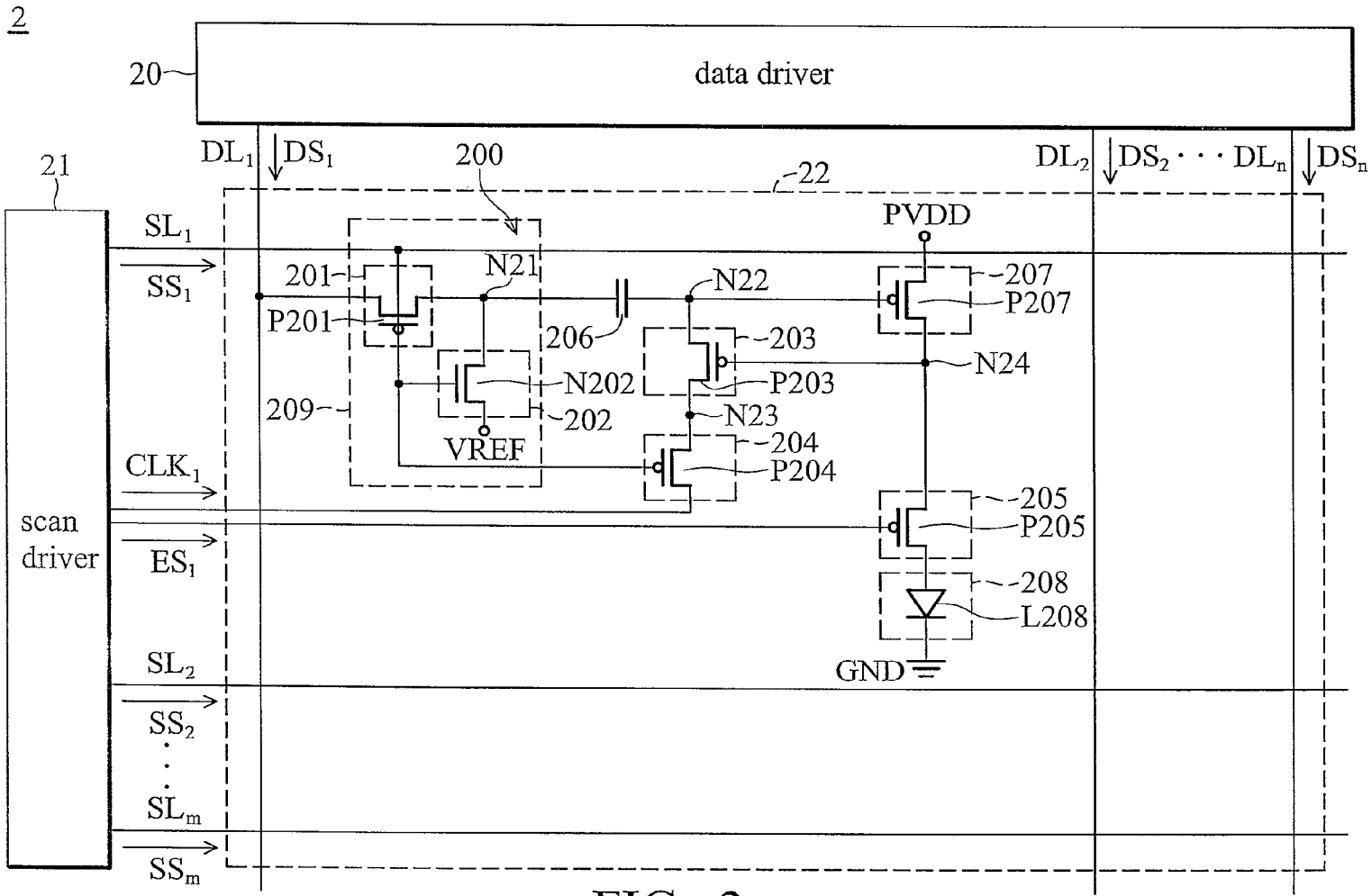
FIG. 2 shows an exemplary embodiment of a display panel.

Referring to FIG. 2, like any other pixel, the equivalent circuit of the pixel 200 comprises a transfer circuit 209, switch elements 203-205, a storage capacitor 206, a driving element 207, and a light-emitting element 208. The transfer circuit 209 comprises switch elements 201 and 202 and transfers a data signal or a reference voltage to a first node N21. In this embodiment, the light-emitting element 208 is implemented by a light-emitting diode (LED) L208, the switch elements 201 and 203-205 and the driving element 207 are respectively implemented by PMOS transistors P201, P203-P205, and P207, and the switch element 202 is implemented by an NMOS transistor N202. Each of elements 201-205 and 207 comprises a control terminal, a first terminal, and a second terminal. According to the type of transistor, the control terminal corresponds to a gate, the first terminal corresponds to a drain/source, and the second terminal corresponds to a source/drain.

As shown in FIG. 2, in the pixel 200, a gate of the PMOS transistor P201 receives the scan signal $SS_1$, a source thereof receives a data signal $DS_1$, and a drain thereof is coupled to the node N21. A gate of the NMOS transistor N202 receives the scan signal $SS_1$, a drain thereof is coupled to the node N21, a source thereof is coupled to a reference voltage source VREF providing a reference voltage verf. The storage capacitor 206 is coupled between the first node N21 and a node N22. Referring to FIG. 2, a gate of the PMOS transistor P203 is coupled to a node N24, a source thereof is coupled to the node N22, and a drain thereof is coupled to a node N23. A gate of the PMOS transistor P204 receives the scan signal $SS_1$, a source thereof is coupled to the node N23, a drain thereof receives a clock signal $CLK_1$. A gate of the PMOS transistor P207 is coupled to the node N22, a source thereof is coupled to a supply voltage source PVDD, and a drain thereof is coupled to the node N24. A gate of the PMOS transistor P205 receives an emitting signal $ES_1$ and a source thereof is coupled to the node N24. The LED L208 is coupled between a drain of the PMOS transistor P205 and a ground GND. In this embodiment, the supply voltage source PVDD provides a high level voltage. The clock signal $CLK_1$ and the emitting signal $ES_1$ provided by the scan driver 12 or an extra control circuit. In this embodiment of FIG. 2, the clock signal $CLK_1$ and the emitting signal $ES_1$ are provided by the scan driver 12.

Figure 3:
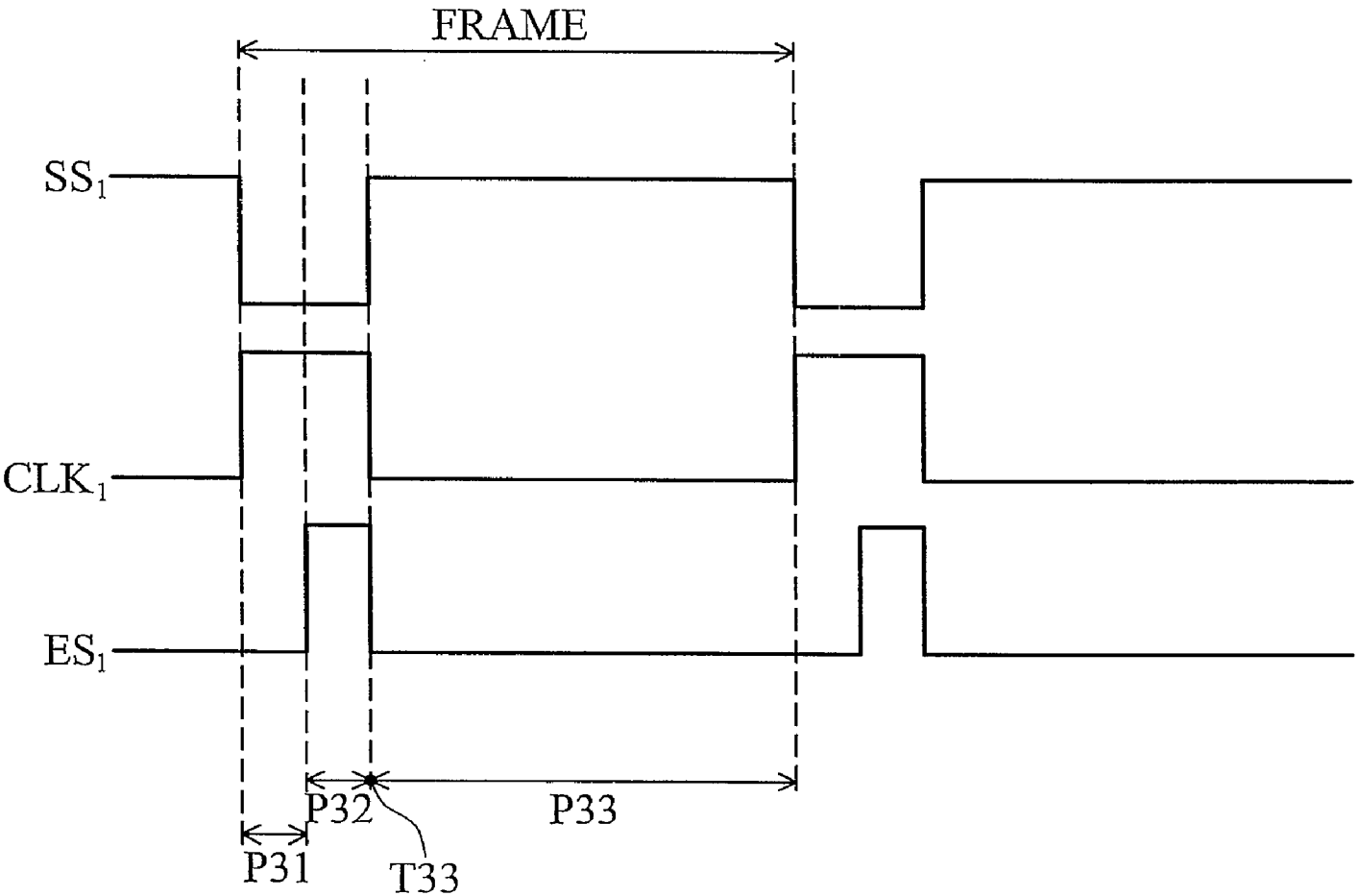
FIG. 3 is a timing chart of a scan signal, a clock signal, and an emitting signal of the embodiment in FIG. 2.

FIG. 3 is a timing chart of the scan signal, clock signal, and emitting signal for one pixel in the embodiment of FIG. 2, wherein the scan signal and the clock signal are inverse. In FIG. 3, the scan signal $SS_1$, the clock signal $CLK_1$, and the emitting signal $ES_1$ corresponding to the pixel 200 are given as an example.

Referring to FIG. 3, one frame FRAM (one operation cycle) is divided into three sequential periods P31-P33. Referring to FIGS. 2 and 3, in the period P31, the scan signal $SS_1$, and the emitting signal $ES_1$, are at a low-logic level, while the clock signal $CLK_1$, is at a high-logic level. Accordingly, the PMOS transistor P201, P204 and P205 are turned on, and the NMOS transistor N202 is turned off. In this embodiment, the high level of the voltage vclk of the clock signal $CLK_1$, is equal to the voltage vpvdd provided by the supply voltage source PVDD. A voltage vn21 at the node N21 is equal to the voltage vdata of the data signal $DS_1$, (v21=vdata), in other words, the data signal $DS_1$, is written into the pixel 200. Due to the turned-on PMOS transistor P205, a voltage vn24 at the node N24 is discharged to the low-logic level for turning on the PMOS transistor P203. Because the PMOS transistors P203 and. P204 are turned on, a voltage vn22 at the node N22 is equal to the high-logic level voltage vclk of the clock signal $CLK_1$, (vn22=vclk=vpvdd) to turn off the PMOS transistor P207.

In the period P32, referring FIGS. 2 and 3, the scan signal $SS_1$, remains at the low-logic level, the clock signal $CLK_1$, remains at the high-logic level, and the emitting signal $ES_1$, switches to the high-logic level to turn off the PMOS transistor P205. The voltage vn21 at the node N21 is still equal to the voltage vdata of the data signal $DS_1$, (v21=vdata), and the voltage vn22 at the node N22 is still equal to the voltage vclk of the clock signal $CLK_1$, (vn22=vclk=vpvdd). The voltage vn24 at the node N24 is equal to a low-logic level voltage vx (vn24=vx).

Then, at a beginning time point T33 of the period P33, the clock signal $CLK_1$, switches to the low-logic level, and the voltage vn22 at the node N22 thus becomes to the low-logic level voltage to turn on the PMOS transistor P207. Due to the turned-on PMOS transistor P207, the voltage vn24 at the node N24 becomes to the high-logic level to turn off the PMOS transistor P203. Moreover, the scan signal $SS_1$, switches to the high-logic level to turn off the PMOS transistors P201 and P204 and turn on the NMOS transistor N202. The voltage vn21 is equal to (vdata−Δv), wherein Δv=vdata−vref, and the voltage vn21 is given by:

$$v21=v\text{data}-\Delta v=v\text{data}-(v\text{data}-v\text{ref})=v\text{ref}$$

Because to the node N22 is floating, the nodes N21 and N22 at the two terminals of the storage capacitor 206 have the same voltage difference. The voltage vn22 is given by:

$$\begin{aligned} vn22 &= vpvdd - |vth| - \Delta v \\ &= pvdd - |vth| - (vdata - vref) \\ &= vpvdd - |vth| - vdata + vref \end{aligned}$$

where vth represents a threshold voltage of the PMOS transistor P207.

In the period P33, the PMOS transistor P207 provides a driving current Id, and the driving current Id is given by:

$$\begin{aligned} id &= 1/2 \cdot k \cdot (vsg + vth)^2 \qquad \text{(Equation 1)} \\ &= 1/2 \cdot k \cdot [(vpvdd - vn22) - |vth|]^2 \\ &= 1/2 \cdot k \cdot \\ &\quad \{[vpvdd - (vpvdd - |vth| - vdata + vref)] - |vth|\}^2 \\ &= 1/2 \cdot k \cdot \\ &\quad (vpvdd - vpvdd + |vth| + vdata - vref - |vth|)^2 \\ &= 1/2 \cdot k \cdot (vdata - vref)^2 \end{aligned}$$

where id and k represent a value of the driving current Id and a conductive parameter of the PMOS transistor P207 respectively.

Referring to FIG. 3, at the beginning time point T33, the emitting signal $ES_1$ switches to the low-logic level, and the driving current Id drives the LED L208 to emit light. In some embodiments, the emitting signal $ES_1$, can switch to the low-logic level at a time point later than the beginning time point T33 in the period P33, and the LED L20 8 emits light later than the time point T33.

According to Equation 1, the threshold voltage of the PMOS transistor P207 does not affect the driving current Id. In other words, the electrical difference of the driving elements due to the fabrication process thereof does not affect the brightness of the light-emitting elements, thus, uneven images are prevented.

Moreover, in conventional large display panels, the pixel, which farther from the input port 21, corresponds to greater equivalent resistance of the power line of the supply voltage source PVDD and receives weak voltage, resulting in unequal brightness. According to Equation 1, the voltage vpvdd from the supply voltage source PVDD does not affect the driving current Id, thus, unequal brightness resulting from the long power line is prevented.

Figure 4:
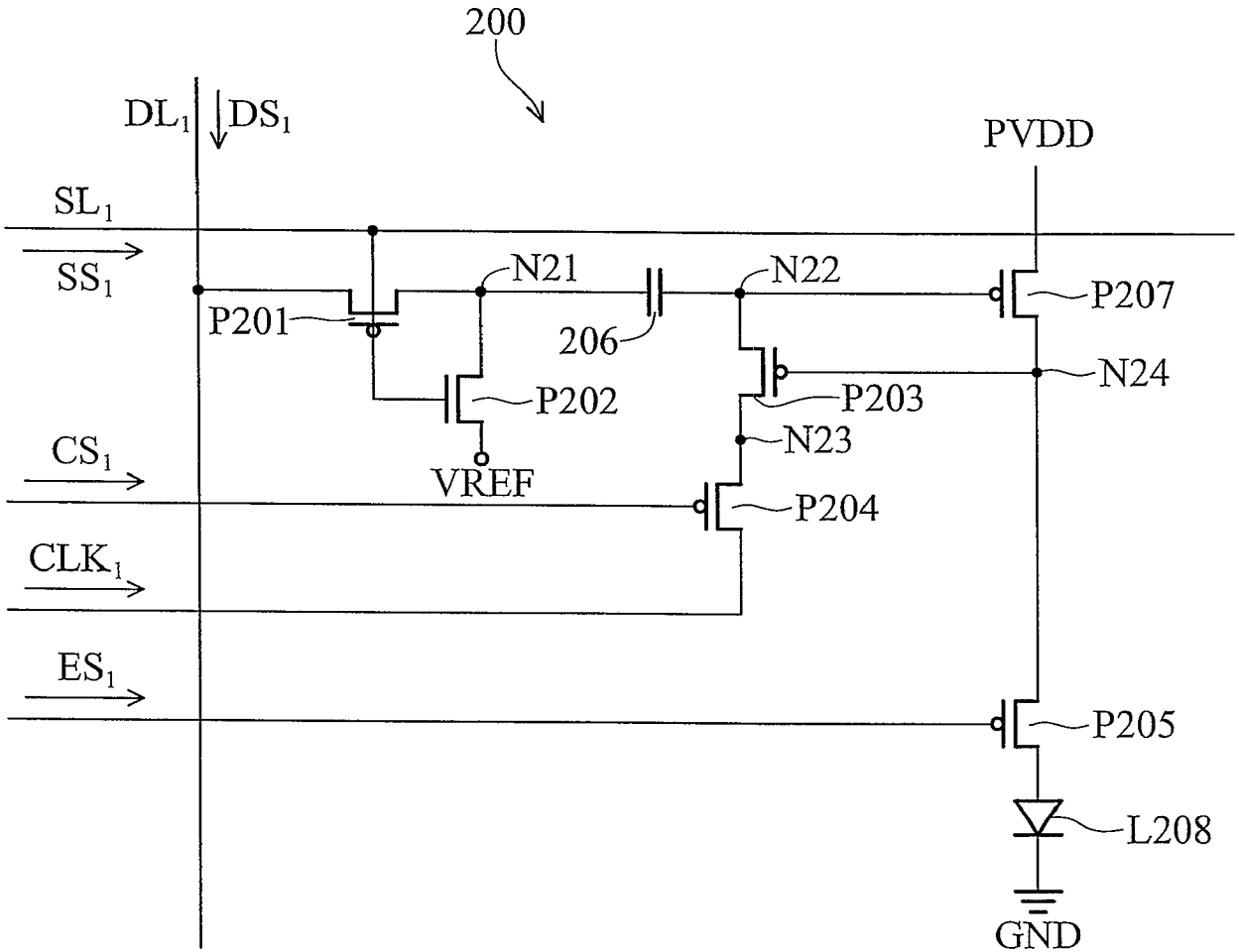
FIG. 4 shows an exemplary embodiment of a pixel.
Figure 5:
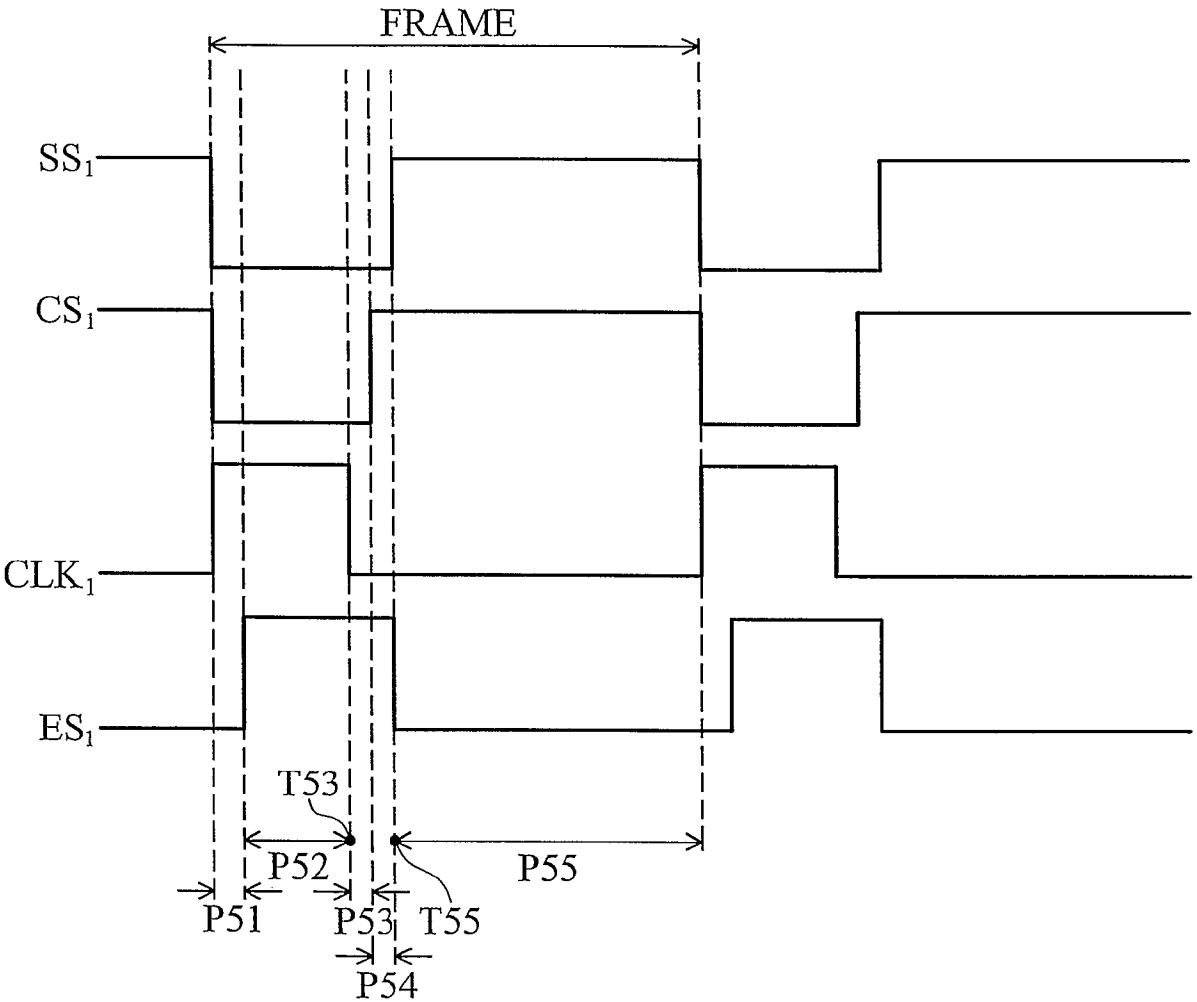
FIG. 5 is a timing chart of a scan signal, a control signal, a clock signal, and an emitting signal of the embodiment in FIG. 4.

Noted that the gate of the PMOS transistor P204 in the embodiment of FIG. 2 receives the scan signal $SS_1$. In some embodiments, the gate of the PMOS transistor P204 can receive a control signal $CS_1$, which is provided by the scan driver 21 or an extra circuit, as shown in FIG. 4. FIG. 5 is a timing chart of the scan signal, control signal, clock signal, and emitting signal for one pixel in the embodiment of FIG. 4. In FIG. 5, the scan signal $SS_1$, control signal $CS_1$, the clock signal $CLK_1$, and the emitting signal $ES_1$, corresponding to the pixel 200 are given as an example.

Referring to FIG. 5, one frame FRAM (one operation cycle) is divided into five sequential periods P51-P55. Referring to FIGS. 4 and 5, in the period P51, the scan signal $SS_1$, the control signal $CS_1$, and the emitting signal $ES_1$ are at a low-logic level, while the clock signal $CLK_1$ is at a high-logic level. Accordingly, the PMOS transistor P201, P204 and P205 are turned on, and the NMOS transistor N202 is turned off. In this embodiment, the high level of the voltage vclk of the clock signal $CLK_1$, is equal to the voltage vpvdd provided by the supply voltage source PVDD. A voltage vn21 at the node N21 is equal to the voltage vdata of the data signal $DS_1$ (v21=vdata), in other words, the data signal $DS_1$ begines being written into the pixel 200. Due to the turned-on PMOS transistor P205, a voltage vn24 at the node N24 is discharged to the low-logic level for turning on the PMOS transistor P203. Because the PMOS transistors P203 and P204 are turned on, a voltage vn22 at the node N22 is equal to the high-logic level voltage vclk of the clock signal $CLK_1$, (vn22=vclk=vpvdd) to turn off the PMOS transistor P207.

In the period P52, referring FIGS. 4 and 5, the scan signal $SS_1$, and the control signal $CS_1$, remains at the low-logic level, the clock signal $CLK_1$ remains at the high-logic level. The emitting signal $ES_1$ switches to the high-logic level to turn off the PMOS transistor P205. The voltage vn21 at the node N21 is still equal to the voltage of the data signal $DS_1$ (v21=vdata), and the voltage vn22 at the node N22 is equal to the voltage vclk of the clock signal $CLK_1$ (vn22=vclk=vpvdd). The voltage vn24 at the node N24 is equal to a low-logic level voltage vx (vn24=vx).

Then, in the period P53, the scan signal $SS_1$ and the control signal $CS_1$ remain at the low-logic level, and the emitting signal $ES_1$, remains at the high-logic level. The voltage vn21 at the node N21 is still equal to the voltage of the data signal $DS_1$ (v21=vdata). The clock signal $CLK_1$, switches to the low-logic level at a beginning time point T53, and the voltage vn22 at the node N22 thus becomes to the low-logic level voltage to turn on the PMOS transistor P207. Due to the turned-on PMOS transistor P207, the voltage vn4 at the node N24 becomes to the high-logic level to turn off the PMOS transistor P203. After the PMOS transistor P207 is turned on, the voltage vn22 is equal to (vpvdd−vth), where vth is a threshold voltage of the PMOS transistor P207.

In the period P54, the scan signal $SS_1$ and the clock signal $CLK_1$, remain at the low-logic level, and the emitting signal $ES_1$ remains at the high-logic level. The control signal $CS_1$ switches to the high-logic level to turn off the PMOS transistor P204. The voltage vn21 at the node N21 is still equal to the voltage of the data signal $DS_1$ (v21=vdata). The voltage vn22 at the node N22 is equal to (vpvdd−vth).

39 Then, at a beginning time point T55 in the period P55, the scan signal $SS_1$, switches to the high-logic level to turn off the PMOS transistor P201 and turn on the NMOS transistor N202. The voltage vn21 is equal to (vdata−Δv), wherein Δv=vdata−vref, and the voltage vn21 is given by:

$$v21=v\text{data}-\Delta v=v\text{data}-(v\text{data}-v\text{ref})=v\text{ref}$$

The clock signal $CLK_1$ remains at the low-logic level to turn off the PMOS transistor P204. Because to the node N22 is floating, the nodes N21 and N22 at the two terminals of the storage capacitor 206 have the same voltage difference. The voltage vn22 is given by:

$$\begin{aligned} vn22 &= vpvdd - |vth| - \Delta v \\ &= vpvdd - |vth| - (vdata - vref) \\ &= vpvdd - |vth| - vdata + vref \end{aligned}$$

where vth represents a threshold voltage of the PMOS transistor P207.

In the period P55, because the PMOS transistor P207 remains in the turned-on state, it provides a driving current Id, and the driving current Id is given by:

$$\begin{aligned} id &= 1/2 \cdot k \cdot (vsg + vth)^2 \\ &= 1/2 \cdot k \cdot [(vpvdd - vn22) - |vth|]^2 \\ &= 1/2 \cdot k \cdot \\ &\quad \{[vpvdd - (vpvdd - |vth| - vdata + vref)] - |vth|\}^2 \\ &= 1/2 \cdot k \cdot \\ &\quad (vpvdd - vpvdd + |vth| + vdata - vref - |vth|)^2 \\ &= 1/2 \cdot k \cdot (vdata - vref)^2 \end{aligned} \quad \text{(Equation 2)}$$

where id and k represent a value of the driving current Id and a conductive parameter of the PMOS transistor P207 respectively.

Referring to FIG. 5, at the beginning time point T55, the emitting signal $ES_1$ switches to the low-logic level, and the driving current Id drives the LED L208 to emit light. In some embodiments, the emitting signal $ES_1$ can switch to the low-logic level at a time point later than the time point T55 in the period P55, and the LED L208 emits light later than the time point T55.

According to Equation 2, the threshold voltage of the PMOS transistor P207 does not affect the driving current Id. In other words, the electrical difference of the driving elements due to the fabrication process thereof does not affect the brightness of the light-emitting elements, thus, uneven images are prevented. Moreover, the voltage vpvdd from the supply voltage source PVDD does not affect the driving current Id, thus, unequal brightness resulting from the long power line is prevented.

Figure 6:
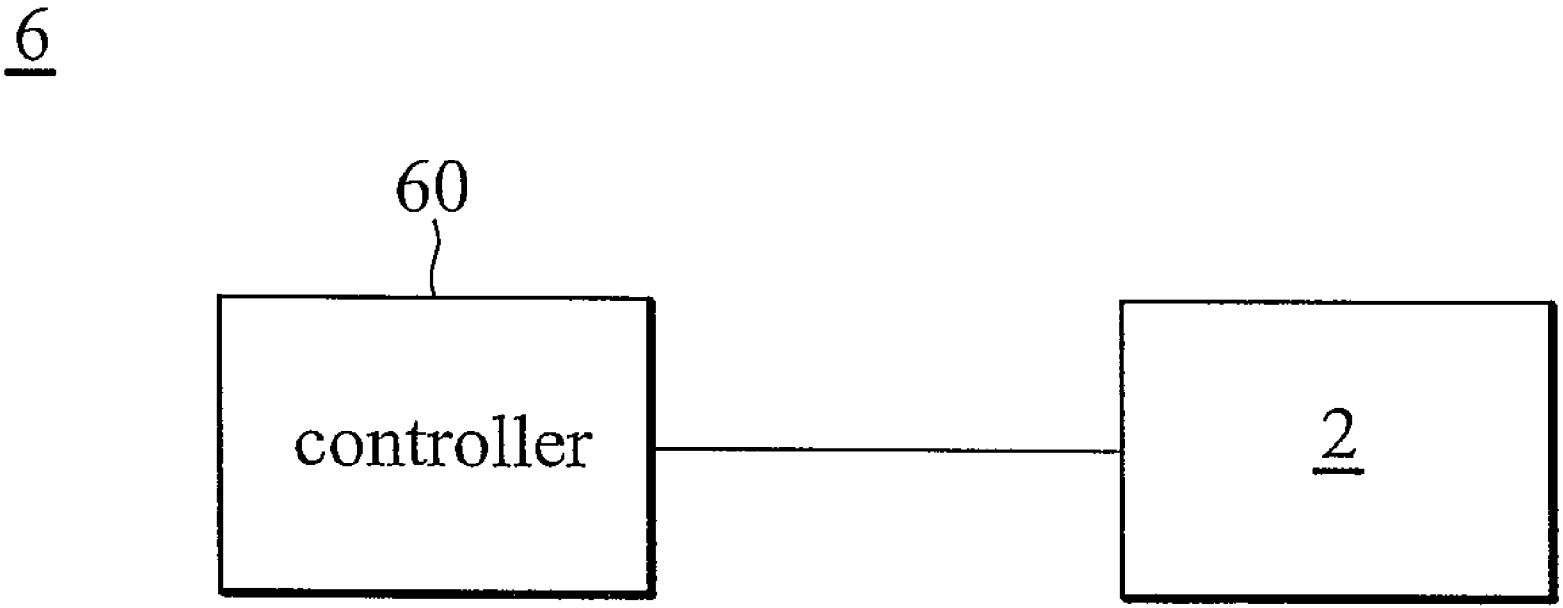
FIG. 6 shows an exemplary embodiment of a display device employing the display panel device disclosed in FIG. 2.

FIG. 6 schematically shows a display device 6 employing the disclosed display panel 2. Generally, the display device 6 includes a controller 60, and the display panel 2 shown in FIG. 2, etc. The controller 60 is operatively coupled to the display panel 2 and provides control signals, such as start pulses, or image data, etc, to the display panel 2.

Figure 7:
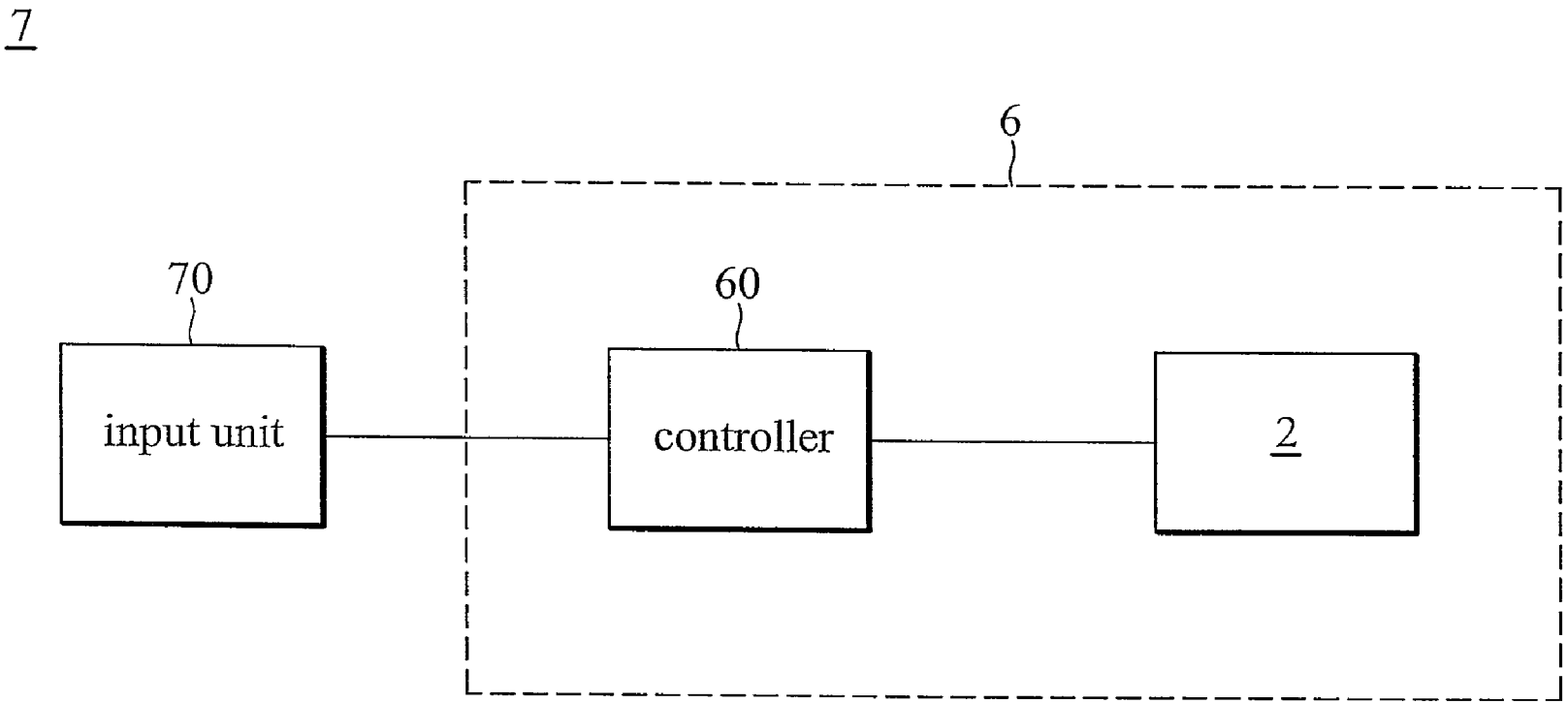
FIG. 7 shows an exemplary embodiment of an electronic device employing the display device disclosed in FIG. 6.

FIG. 7 schematically shows an electronic device 7 employing the disclosed display device 6. The electronic device 7 may be a portable device such as a PDA, digital camera, notebook computer, tablet computer, cellular phone, a display monitor device, or similar. Generally, the electronic device 7 comprises an input unit 70 and the display device 6 shown in FIG. 6, etc. Further, the input unit 70 is operatively coupled to the display device 6 and provides input signals (e.g., image signal) to the display device 6. The controller 60 of the display device 6 provides the control signals to the display panel 2 according to the input signals.

While the present invention has been described in terms of preferred embodiments, it is to be understood that the present invention is not limited thereto. Rather, it is intended to cover various modifications and similar arrangements as would be apparent to those skilled in the art. Thus, the scope of the appended claims should be accorded the broadest interpretation so as to encompass all such modifications and similar arrangements.

What is claimed is:

1. A pixel comprising:

a capacitor coupled between the first node and a second node;

a transfer circuit coupled to the first node and transferring a data signal or a reference voltage to the first node;

a first switch element having a control terminal, a first terminal coupled to the second node, and a second terminal coupled to a third node;

a second switch element having a first terminal coupled to the third node and a second terminal receiving a clock signal;

a driving element having a control terminal coupled to the second node, a first terminal coupled to a supply voltage source, and a second terminal coupled to the control terminal of the first switch element at a fourth node;

a third switch element having a control terminal receiving an emitting signal, a first terminal coupled to the fourth node, and a second terminal; and a light-emitting element coupled between the second terminal of the third switch element and a ground.

2. The pixel as claimed in claim 1, wherein the transfer circuit comprises:

a fourth switch element having a control terminal receiving the scan signal, a first terminal receiving the data signal, and a second terminal coupled to the first node; and a fifth switch element having a control terminal receiving the scan signal, a first terminal coupled to the first node, a second terminal coupled to the reference voltage source.

3. The pixel as claimed in claim 2, wherein the second switch element further has a control terminal receiving the scan signal.

4. The pixel as claimed in claim 2, wherein an operation cycle of the pixel is divided into sequential first, second, and third periods, a voltage of the data signal is written into the pixel in the first period, and the light-emitting element emits light in the third period.

5. The pixel as claimed in claim 4, wherein in the first period, the second and fourth switch elements are turned on according to the scan signal, the fifth switch element is turned off according to the scan signal, and the third switch element is turned on according to the emitting signal.

6. The pixel as claimed in claim 5, wherein in the second period, the third switch element is turned off according to the emitting signal.

7. The pixel as claimed in claim 6, wherein at a first time point in the third period, the second and fourth switch elements are turned off according to the scan signal, the fifth switch element is turned on according to the scan signal, and the third switch element is turned on according to the emitting signal.

8. The pixel as claimed in claim 7, wherein in the third period, the second and fourth switch elements are turned off according to the scan signal, and the fifth switch element is turned on according to the scan signal at a first time point, and the third switch element is turned on according to the emitting signal at a second time point later than the first time point.

9. The pixel as claimed in claim 8, wherein the power voltage source provides a high-logic level voltage, and the clock signal is at a high-logic level in the first and second periods and at a low-logic level in the third period.

10. The pixel as claimed in claim 2, wherein the second switch element further has a control terminal receiving a control signal.

11. The pixel as claimed in claim 10, wherein an operation cycle of the pixel is divided into sequential first, second, third, fourth, and fifth periods, a voltage of the data signal is written into the pixel in the first period, and the light-emitting element emits light in the fifth period.

12. The pixel as claimed in claim 11, wherein in the first period, the fourth and fifth switch elements are respectively turned on and off according to the scan signal, the second switch element is turned on according to the control signal, and the third switch element is turned on according to the emitting signal.

13. The pixel as claimed in claim 12, wherein in the second period, the third switch element is turned off according to the emitting signal.

14. The pixel as claimed in claim 13, wherein in the fourth period, the second switch element is turned off according to the control signal.

15. The pixel as claimed in claim 14, wherein at a first time point in the fifth period, the fourth and fifth switch elements are respectively turned off and on according to the scan signal, and the third switch element is turned on according to the emitting signal.

16. The pixel as claimed in claim 15, wherein in the third period, the fourth and fifth switch elements are respectively turned off and on according to the scan signal, at a first time point, and the third switch element is turned on according to the emitting signal at a second time point later than the first time point.

17. A display panel, comprising:

a data driver providing a plurality of data signals through a plurality of data lines;

a scan driver providing a plurality of scan signals through a plurality of scan lines, wherein the scan lines are interlaced with the data lines; and a display array formed by the data lines and the scan lines and comprising a plurality of pixels as claimed in claim 1, wherein each of the pixels comprises:

a capacitor coupled between the first node and a second node;

a transfer circuit coupled to the first node and transferring a data signal or a reference voltage to the first node;

a first switch element having a control terminal, a first terminal coupled to the second node, and a second terminal coupled to a third node;

a second switch element having a first terminal coupled to the third node and a second terminal receiving a clock signal;

a driving element having a control terminal coupled to the second node, a first terminal coupled to a supply voltage source, and a second terminal coupled to the control terminal of the first switch element at a fourth node;

a third switch element having a control terminal receiving an emitting signal, a first terminal coupled to the fourth node, and a second terminal; and a light-emitting element coupled between the second terminal of the third switch element and a ground.

18. A display device, comprising:

a display panel as claimed in claim 17; and a controller, wherein the controller is operatively coupled to the display panel.

19. An electronic device, comprising:

a display device as claimed in claim 18; and an input unit, wherein the input unit is operatively coupled to the display device.

20. The electronic device as claimed in claim 19, wherein the electronic device is a PDA, a digital camera, a display monitor, a notebook computer, a tablet computer, or a cellular phone.

* * * * *